US011746551B2

(12) United States Patent
Ellingson

(10) Patent No.: US 11,746,551 B2
(45) Date of Patent: Sep. 5, 2023

(54) SYSTEM AND METHOD FOR PYLON ANCHORING

(71) Applicant: REESE ENTERPRISES, INC., Rosemount, MN (US)

(72) Inventor: Robert T. Ellingson, Social Circle, GA (US)

( * ) Notice: Subject to any disclaimer, the term of this patent is extended or adjusted under 35 U.S.C. 154(b) by 0 days.

(21) Appl. No.: 17/385,013

(22) Filed: Jul. 26, 2021

(65) Prior Publication Data

US 2023/0028488 A1 Jan. 26, 2023

(51) Int. Cl.
*E04H 12/22* (2006.01)

(52) U.S. Cl.
CPC ..... *E04H 12/2223* (2013.01); *E04H 12/2253* (2013.01)

(58) Field of Classification Search
CPC . E04H 12/22; E04H 12/2215; E04H 12/2223; E04H 12/223; E04H 12/2238; E04H 12/2253; E04H 12/2269
USPC ..... 52/155–158
See application file for complete search history.

(56) References Cited

U.S. PATENT DOCUMENTS 3,342,444 A * 9/1967 Nelson ..... E04H 12/2215 52/165
4,355,201 A * 10/1982 Wilson, Sr. ..... H01B 17/145 174/166 R
6,928,768 B1 * 8/2005 Snow ..... A01M 29/26 256/10
7,025,016 B1 * 4/2006 Landes ..... E01F 9/685 52/154
8,584,413 B1 * 11/2013 Keller, Sr. ..... E02D 27/32 52/297
10,344,496 B1 * 7/2019 Cefalo ..... E04H 12/2215
2008/0308288 A1 * 12/2008 Crutcher ..... H01R 4/66 174/6
2011/0197542 A1 * 8/2011 O'Toole ..... E04H 17/22 248/219.4
2014/0326283 A1 * 11/2014 Silberman ..... A45B 25/22 135/15.1
2014/0373461 A1 * 12/2014 Rodriguez ..... E04H 12/2215 52/297
2016/0138297 A1 * 5/2016 Gibbs ..... E04H 12/22 248/530
2018/0230664 A1 * 8/2018 Dominguez ..... E02D 5/54
2020/0109529 A1 * 4/2020 Kemmish ..... E01F 9/685

* cited by examiner

*Primary Examiner* — William V Gilbert
(74) *Attorney, Agent, or Firm* — Smith Tempel Blaha LLC; Matthew T. Hoots

(57) ABSTRACT

Disclosed is a pylon anchoring system in the form of an extruded strip that may be wrapped around, and affixed to, a pylon or post such that the pylon anchoring system is positioned beneath a sand line when the pylon or post is installed and set. Advantageously, when the post or pylon is installed such that the pylon anchoring strip is positioned beneath sand (or some other ground surface), a plurality of anchor elements on the system generate a counteracting force to any external force that might cause the pylon to shift from a set position.

11 Claims, 14 Drawing Sheets

SYSTEM AND METHOD FOR PYLON ANCHORING

BACKGROUND

Maintenance and preservation of structural integrity is an ever present concern for owners of structures located near large bodies of water. As inclement weather, time and time again, brings relentlessly crashing waves and currents along with powerful winds and updrafts, the pylons that support structures such as docks and piers can literally be lifted or shifted out of their installed positions. As one of ordinary skill in the art would understand, lifting or shifting of the pylons that support a structure can jeopardize the structural integrity of the entire structure.

The prior art is essentially devoid of solutions for ensuring that a pylon resists being lifted from its installed position when the structure it supports is subjected to forces of nature. Therefore, there is a need in the art for a system and method that can mitigate the negative effects of natural forces to dislodge pylons from their installed positions. More specifically, there is a need in the art for a system that may be easily applied to a pylon such that, when the pylon is installed, the pylon better resists being dislodged.

BRIEF SUMMARY

The presently disclosed embodiments, as well as features and aspects thereof, are directed towards a pylon anchoring system in the form of an extruded strip that may be wrapped around, and affixed to, a pylon or post such that the pylon anchoring system is positioned beneath a sand line when the pylon or post is installed and set.

An exemplary embodiment of a pylon anchoring strip is extruded from a thermoplastic polymer and comprises an upper fastening surface and a lower fastening surface that may be wrapped around the exterior circumference of a post or pylon. Alternative embodiments may only include a single upper or lower fastening surface. Returning to the exemplary embodiment, a plurality of fasteners may be installed through the upper and lower fastening surfaces such that the pylon anchoring strip is affixed to the exterior of the post or pylon. In some embodiments, at least one of the upper and lower fastening surfaces may comprise one or more fastener placement holes. A plurality of anchor elements extends away from the post or pylon when the upper fastening surface and lower fastening surface are wrapped around the exterior circumference of the post or pylon. Advantageously, when the post or pylon is installed such that the pylon anchoring strip is positioned beneath sand (or some other ground surface), the plurality of anchor elements generate a counteracting force to any external force that might cause the pylon to shift from a set position. The anchor elements, depending on embodiment, may define a triangular profile, or may define fins that extend away and at an angle from the post or pylon, or may define fins that extend horizontally away from the post or pylon. It is envisioned that embodiments of the solution may be installed in discrete lengths cut to approximate the circumference of the post or pylon or, alternatively, may be installed in one relatively long length that is spiral wrapped around the post or pylon.

BRIEF DESCRIPTION OF THE SEVERAL VIEWS OF THE DRAWING

In the Figures, like reference numerals refer to like parts throughout the various views unless otherwise indicated. For reference numerals with letter character designations such as "102A" or "102B", the letter character designations may differentiate two like parts or elements present in the same Figure. Letter character designations for reference numerals may be omitted when it is intended that a reference numeral to encompass all parts having the same reference numeral in all Figures.

DETAILED DESCRIPTION

Aspects, features and advantages of several exemplary embodiments of the systems and methods for pylon anchoring will become better understood with regard to the following description in connection with the accompanying drawing(s). It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the systems and methods as defined herein and equivalents thereto. Hence, use of absolute terms such as, for example, "will," "will not," "shall," "shall not," "must" and "must not" are not meant to limit the scope of the present invention as the embodiments disclosed herein are merely exemplary. Moreover, the word "exemplary" is used herein to mean "serving as an example, instance, or illustration." Any aspect described herein as "exemplary" is not necessarily to be construed as exclusive, preferred or advantageous over other aspects.

The presently disclosed embodiments, as well as features and aspects thereof, are directed towards providing a system and method for anchoring pylons and mitigating upheaval or displacement. Embodiments of the systems and methods for pylon anchoring according to the solution are useful for, among other purposes, mitigating movement or upheaval of pylons, pilings or posts that have been anchored in a sea bed or lake bed to support a structure such as a dock or pier. In this description, the term "pylon" is used generally to refer to any post, piling, pylon or other structural support element installed in a sea bed or lake bed or the like for the purpose of supporting a structure such as, but not limited to, a deck or pier or housing structure.

In this description, the term "fastener" refers to a threaded screw, nail or other mechanical means for attaching a component of the illuminated dock board system to a support structure, such as a pylon or joist. Choice of fasteners will occur to those of skill in the art.

It is envisioned that embodiments of the solution, or components of embodiments, may be extruded using thermoplastic polymers, as would be understood by one of ordinary skill in the art.

Figure 1:
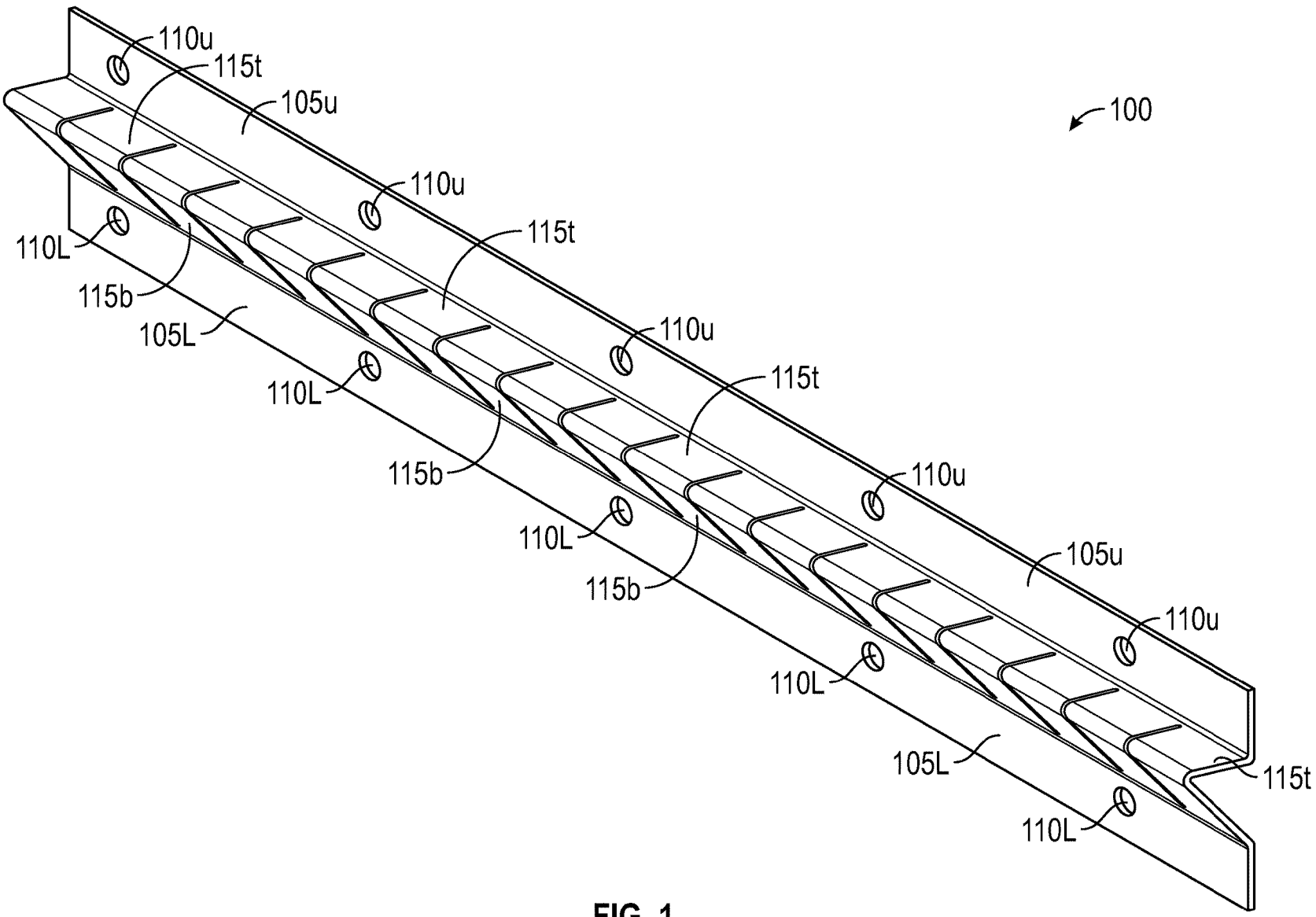
FIG. 1 is a perspective, front-side view of an exemplary embodiment of a pylon anchoring strip according to the solution, the exemplary embodiment featuring triangular anchor elements.
Figure 2:
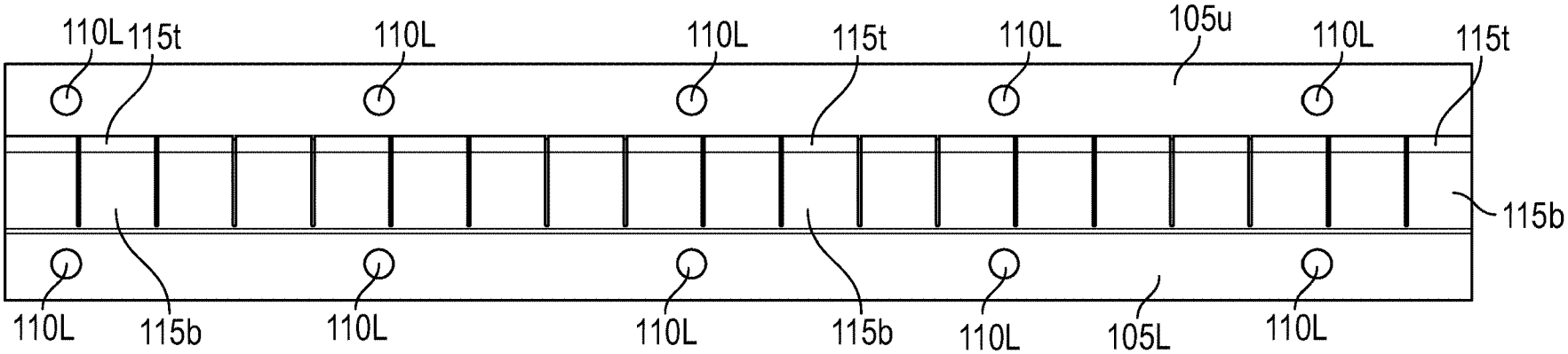
FIG. 2 is a front-side view of the exemplary embodiment of a pylon anchoring strip shown in FIG. 1.
Figure 3:
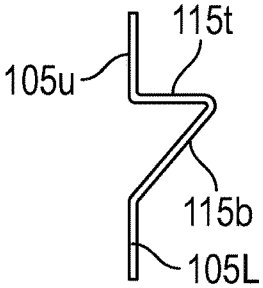
FIG. 3 is an end profile view of the exemplary embodiment of a pylon anchoring strip shown in FIG. 1.
Figure 4:
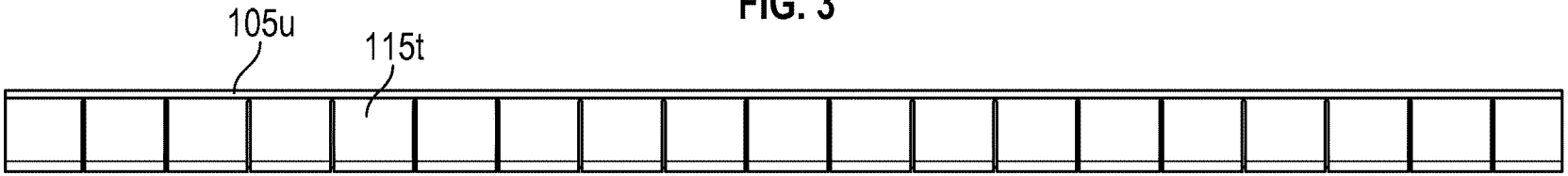
FIG. 4. is a top side view of the exemplary embodiment of a pylon anchoring strip shown in FIG. 1.

FIG. 1 is a perspective, front-side view of an exemplary embodiment of a pylon anchoring strip 100 according to the solution, the exemplary embodiment featuring triangular anchor elements 115. The FIG. 1 illustration will be described in combination with the illustrations in FIGS. 2, 3 and 4 which are front-side, end profile, and top side views, respectively, of the same embodiment illustrated in FIG. 1. One of ordinary skill in the art reading this description and viewing the illustrations shown in FIGS. 1-4 will easily understand the combination of features in the exemplary embodiment 100 that form the novel solution for a pylon anchoring strip and, moreover, will envision and understand alternative, equivalent combinations of features to those demonstrated in the illustrations of FIGS. 1-4 that would also fall within the scope of the novel solution.

The exemplary embodiment 100 for a pylon anchoring strip includes an upper fastening surface 105U and a lower fastening surface 105L. Each of the upper and lower fastening surfaces 105 may comprise one or more fastener placement holes 110, labeled in the illustrations as fastener placement holes 110U on upper fastening surface 105U and fastener placement holes 110L on lower fastening surface 105L. As will become clearer from a review of figures that follow, the pylon anchoring strip 100 may be "wrapped" around a pylon such that the backsides of fastening surfaces 105 contact the outer surface of the pylon. Installation of fasteners such as, but not limited to, screws or nails, through fastener placement holes 110 operate to securely fix the pylon anchoring strip 100 to a pylon. It is envisioned, however, that all embodiments of a pylon anchoring strip according to the solution may not include fastener placement holes 110 because, depending on the relative thickness and material of construction for fastening surfaces 105, certain fasteners may be operable for installation through the fastening surfaces 105 without the benefit of a predefined placement hole 110.

With the pylon anchoring strip 100 wrapped around and attached to a pylon in the manner described, it can be appreciated that the plurality of triangular anchor elements 115 will protrude outward and away from the pylon. Each triangular anchor element 115 is separate from its adjacent anchor elements, yet integrally connected to the upper and lower fastening surfaces 105. In this way, each given triangular anchor element 115 defines a top surface 115T that integrally connects to upper fastening surface 105U and a bottom surface 115B that likewise integrally connects to lower fastening surface 105L.

In the exemplary embodiment 100 for a pylon anchoring strip, the triangular anchor elements 115 have top surfaces 115T that essentially extend radially and horizontally outward from a pylon when the pylon anchoring strip 100 is installed on a pylon. The bottom surfaces 115B extend radially and upwardly from the a pylon at an acute angle to support their respective top surfaces 115T. As can probably best be understood from the end profile illustration in FIG. 3, when installed on a pylon, both the upper fastening surface 105U and the lower fastening surface 105L are vertical and coplanar with the surface of the pylon while the bottom surface(s) 115B and top surface(s) 115T work together to define triangular anchor element(s) 115 that protrude away from the pylon. As will become better understood from subsequent illustrations, the triangular anchor element(s) 115 create resistance that mitigates any upheaval or shifting of the pylon from its set position.

Notably, it is envisioned that the pylon anchoring strip 100 is not limited to the particular triangular anchor elements demonstrated. That is, it is envisioned that the triangular anchor elements 115 may be define triangles that form top surfaces that extend radially outward and upward from the pylon surface or, similarly, top surfaces that extend radially outward and downward. As such, it is envisioned that the triangular anchor elements 115 may define triangular profiles that are right triangles, or acute triangles, or obtuse triangles. Moreover, the lengths of top surfaces 115T and bottom surfaces 115B are design choices within the level of expertise of one with ordinary skill in the art and, as such, fall within the scope of the solution.

Figure 5:
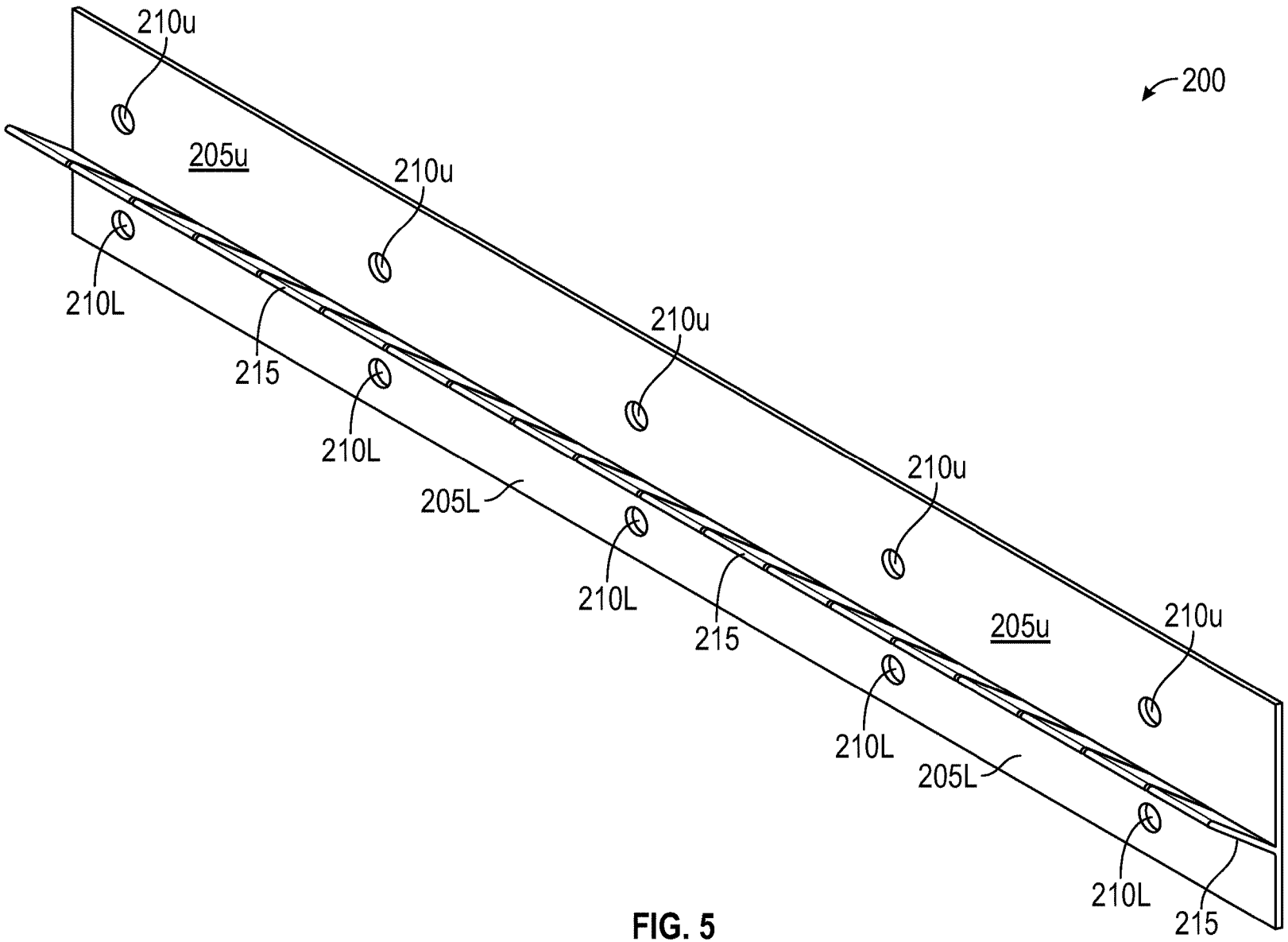
FIG. 5 is a perspective, front-side view of an exemplary embodiment of a pylon anchoring strip according to the solution, the exemplary embodiment featuring upward angled fin anchor elements.
Figure 6:
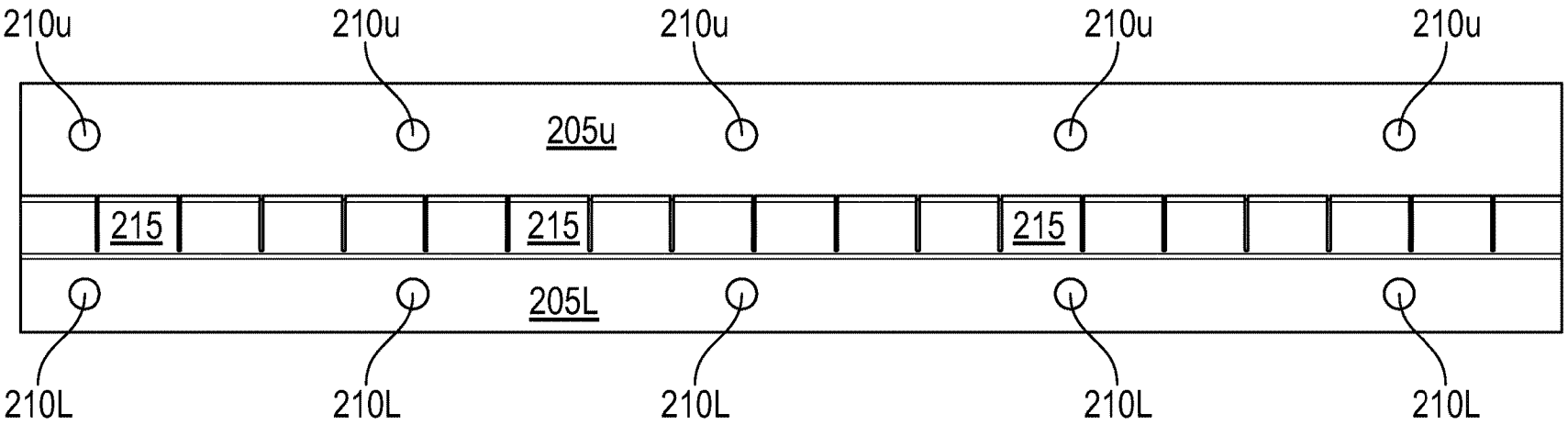
FIG. 6 is a front-side view of the exemplary embodiment of a pylon anchoring strip shown in FIG. 5.
Figure 7:
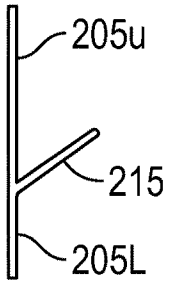
FIG. 7 is an end profile view of the exemplary embodiment of a pylon anchoring strip shown in FIG. 5.
Figure 8:
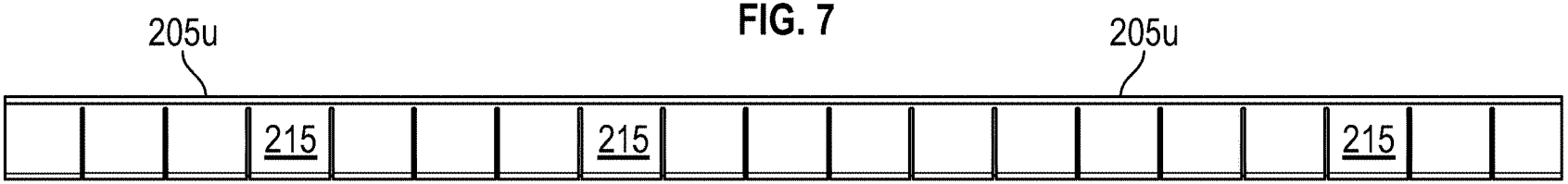
FIG. 8 is a top side view of the exemplary embodiment of a pylon anchoring strip shown in FIG. 5.

Turning now to the FIG. 5 illustration, shown is a perspective, front-side view of an exemplary embodiment 200 of a pylon anchoring strip according to the solution, the exemplary embodiment 200 featuring upward angled fin anchor elements 215. The FIG. 5 illustration will be described in combination with the illustrations in FIGS. 6, 7 and 8 which are front-side, end profile, and top side views, respectively, of the same embodiment illustrated in FIG. 5. One of ordinary skill in the art reading this description and viewing the illustrations shown in FIGS. 5-8 will easily understand the combination of features in the exemplary embodiment 200 that form the novel solution for a pylon anchoring strip and, moreover, will envision and understand alternative, equivalent combinations of features to those demonstrated in the illustrations of FIGS. 5-8 that would also fall within the scope of the novel solution.

The exemplary embodiment 200 for a pylon anchoring strip includes an upper fastening surface 205U and a lower fastening surface 205L. Each of the upper and lower fastening surfaces 205 may comprise one or more fastener placement holes 210, labeled in the illustrations as fastener placement holes 210U on upper fastening surface 205U and fastener placement holes 210L on lower fastening surface 205L. As will become clearer from a review of figures that follow, the pylon anchoring strip 200 may be "wrapped" around a pylon such that the backsides of fastening surfaces 205 contact the outer surface of the pylon. Installation of fasteners such as, but not limited to, screws or nails, through fastener placement holes 210 operate to securely fix the pylon anchoring strip 200 to a pylon. It is envisioned, however, that all embodiments of a pylon anchoring strip according to the solution may not include fastener placement holes 210 because, depending on the relative thickness and material of construction for fastening surfaces 205, certain fasteners may be operable for installation through the fastening surfaces 205 without the benefit of a predefined placement hole 210.

With the pylon anchoring strip 200 wrapped around and attached to a pylon in the manner described, it can be appreciated that the plurality of fin anchor elements 215 will protrude outward and away from the pylon. Each fin anchor element 215 is separate from its adjacent anchor elements, yet integrally connected to the upper and lower fastening surfaces 205. In this way, each given fin anchor element 215 defines a top surface that integrally connects to upper fastening surface 205U and a bottom surface that likewise integrally connects to lower fastening surface 205L.

In the exemplary embodiment 200 for a pylon anchoring strip, the fin anchor elements 215 essentially extend radially outward and upward from the pylon. As can probably best be understood from the end profile illustration in FIG. 7, when installed on a pylon, both the upper fastening surface 205U and the lower fastening surface 205L are vertical and coplanar with the surface of the pylon while the fin anchor element(s) 215 protrude away from the pylon. As will become better understood from subsequent illustrations, the fin anchor element(s) 215 create resistance that mitigates any upheaval or shifting of the pylon from its set position.

Notably, it is envisioned that the pylon anchoring system 200 is not limited to the particular upwardly angled fin anchor elements 215 demonstrated. That is, it is envisioned that the fin anchor elements 215 may be angled upward or downward at any suitable angle away from the pylon. Moreover, the lengths of the fin anchor elements 215 are design choices within the level of expertise of one with ordinary skill in the art and, as such, fall within the scope of the solution.

Figure 9:
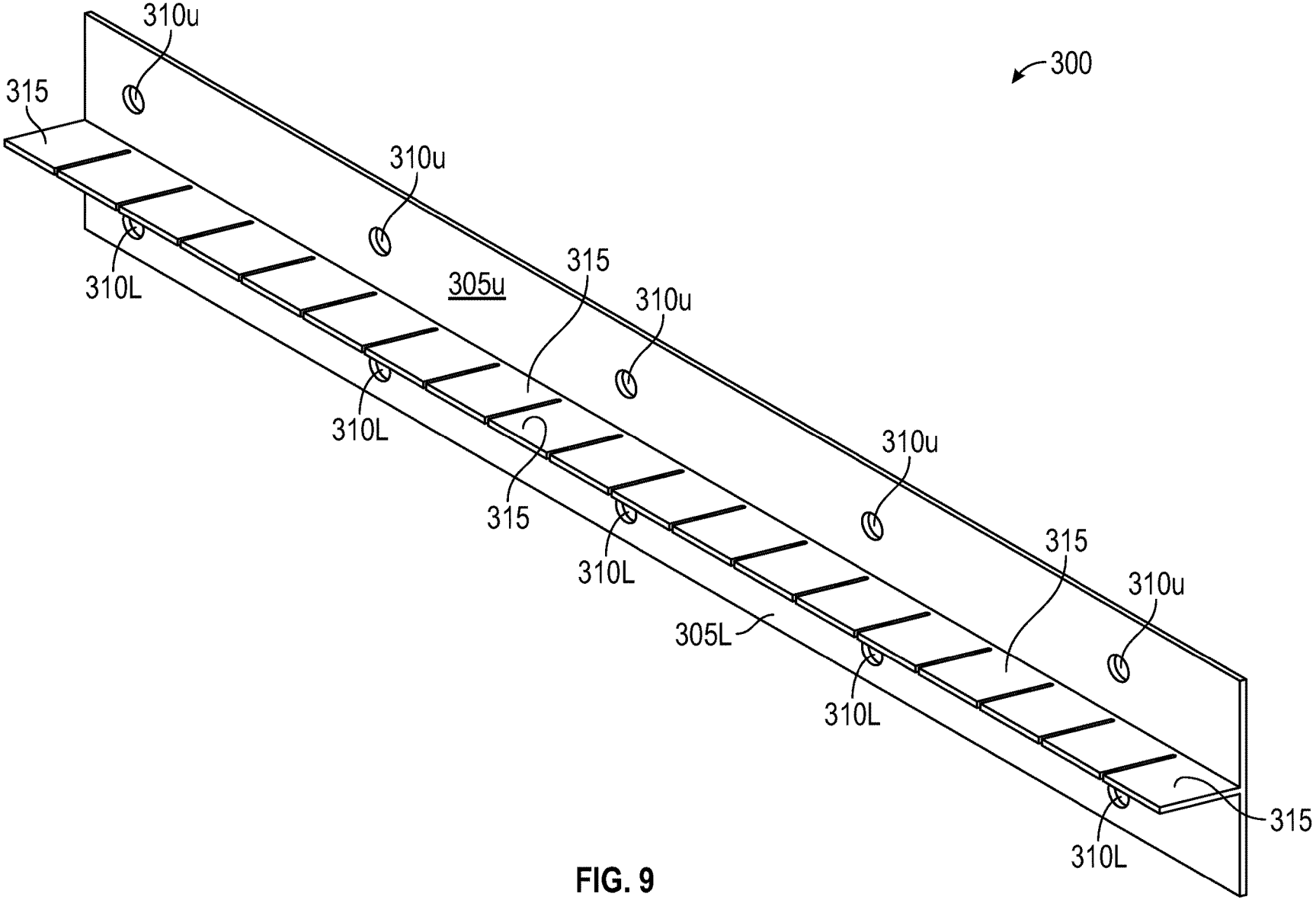
FIG. 9 is a perspective, front-side view of an exemplary embodiment of a pylon anchoring strip according to the solution, the exemplary embodiment featuring horizontal fin anchor elements in a T-shaped profile.
Figure 10:
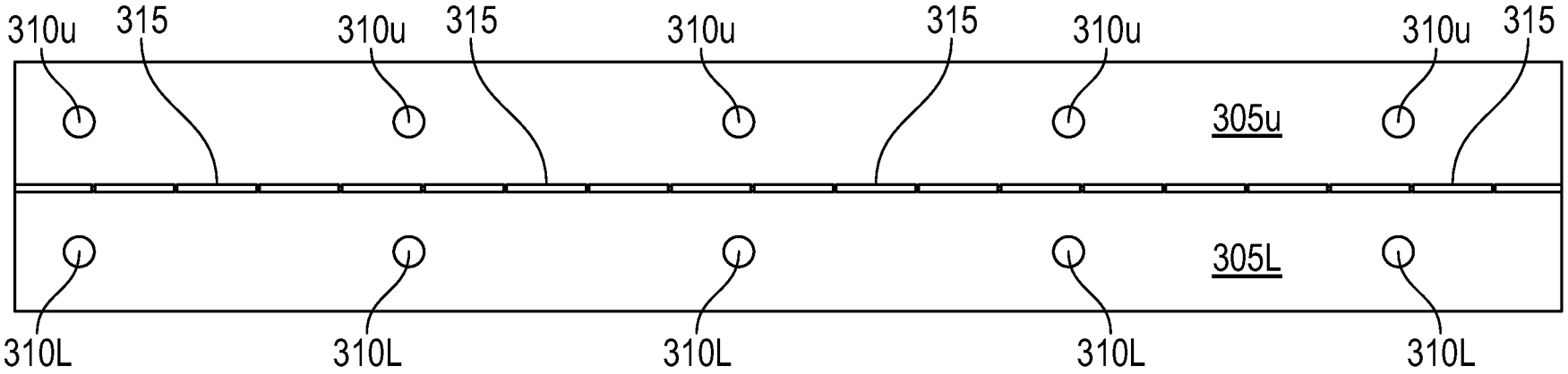
FIG. 10 is a front-side view of the exemplary embodiment of a pylon anchoring strip shown in FIG. 9.
Figure 11:
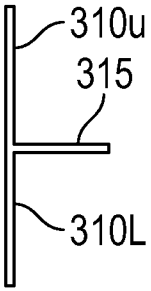
FIG. 11 is an end profile view of the exemplary embodiment of a pylon anchoring strip shown in FIG. 9.
Figure 12:
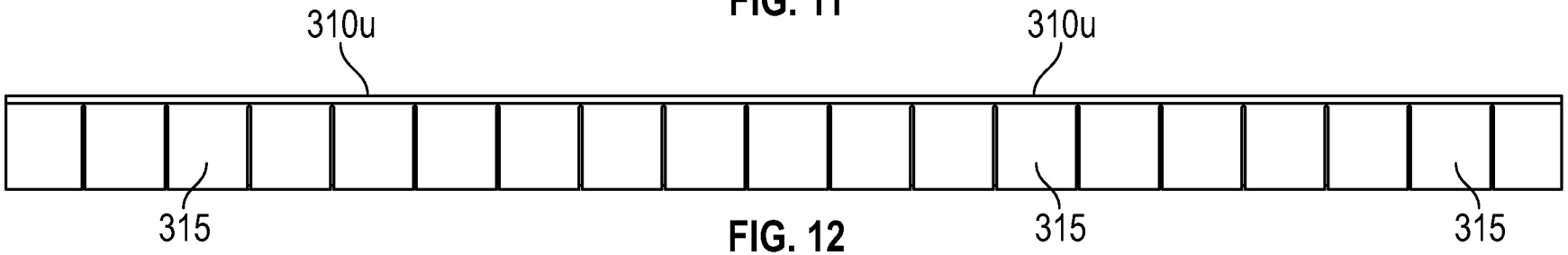
FIG. 12 is a top side view of the exemplary embodiment of a pylon anchoring strip shown in FIG. 9.

Turning now to the FIG. 9 illustration, shown is a perspective, front-side view of an exemplary embodiment 300 of a pylon anchoring strip according to the solution, the exemplary embodiment 300 featuring horizontal fin anchor elements 315 in a T-shaped profile. The FIG. 9 illustration will be described in combination with the illustrations in FIGS. 10, 11 and 12 which are front-side, end profile, and top side views, respectively, of the same embodiment illustrated in FIG. 9. One of ordinary skill in the art reading this description and viewing the illustrations shown in FIGS. 9-12 will easily understand the combination of features in the exemplary embodiment 300 that form the novel solution for a pylon anchoring strip and, moreover, will envision and understand alternative, equivalent combinations of features to those demonstrated in the illustrations of FIGS. 9-12 that would also fall within the scope of the novel solution.

The exemplary embodiment 300 for a pylon anchoring strip includes an upper fastening surface 305U and a lower fastening surface 305L. Each of the upper and lower fastening surfaces 305 may comprise one or more fastener placement holes 310, labeled in the illustrations as fastener placement holes 310U on upper fastening surface 305U and fastener placement holes 310L on lower fastening surface 305L. As will become clearer from a review of figures that follow, the pylon anchoring strip 300 may be "wrapped" around a pylon such that the backsides of fastening surfaces 305 contact the outer surface of the pylon. Installation of fasteners such as, but not limited to, screws or nails, through fastener placement holes 310 operate to securely fix the pylon anchoring strip 300 to a pylon. It is envisioned, however, that all embodiments of a pylon anchoring strip according to the solution may not include fastener placement holes 310 because, depending on the relative thickness and material of construction for fastening surfaces 305, certain fasteners may be operable for installation through the fastening surfaces 305 without the benefit of a predefined placement hole 310.

With the pylon anchoring strip 300 wrapped around and attached to a pylon in the manner described, it can be appreciated that the plurality of fin anchor elements 315 will protrude horizontally outward and away from the pylon. Each fin anchor element 315 is separate from its adjacent anchor elements, yet integrally connected to the upper and lower fastening surfaces 305. In this way, each given fin anchor element 315 defines a top surface that integrally connects to upper fastening surface 305U and a bottom surface that likewise integrally connects to lower fastening surface 305L.

In the exemplary embodiment 300 for a pylon anchoring strip, the fin anchor elements 315 essentially extend radially outward horizontally from the pylon. As can probably best be understood from the end profile illustration in FIG. 11, when installed on a pylon, both the upper fastening surface 305U and the lower fastening surface 305L are vertical and coplanar with the surface of the pylon while the fin anchor element(s) 315 protrude away from the pylon. As will become better understood from subsequent illustrations, the fin anchor element(s) 315 create resistance that mitigates any upheaval or shifting of the pylon from its set position. The lengths of the fin anchor elements 315 are design choices within the level of expertise of one with ordinary skill in the art and, as such, fall within the scope of the solution.

Figure 13:
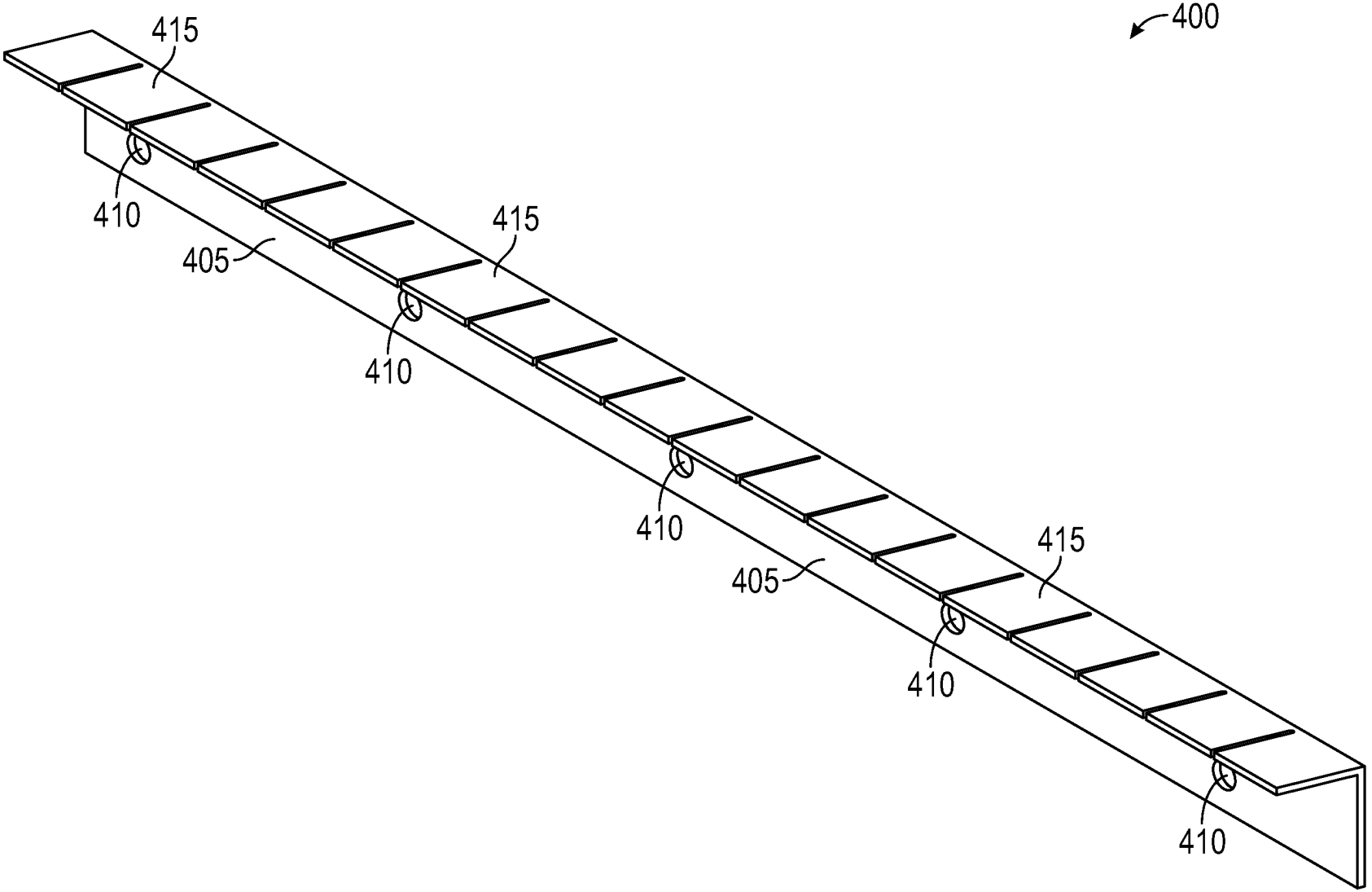
FIG. 13 is a perspective, front-side view of an exemplary embodiment of a pylon anchoring strip according to the solution, the exemplary embodiment featuring horizontal fin anchor elements in an L-shaped profile.
Figure 14:
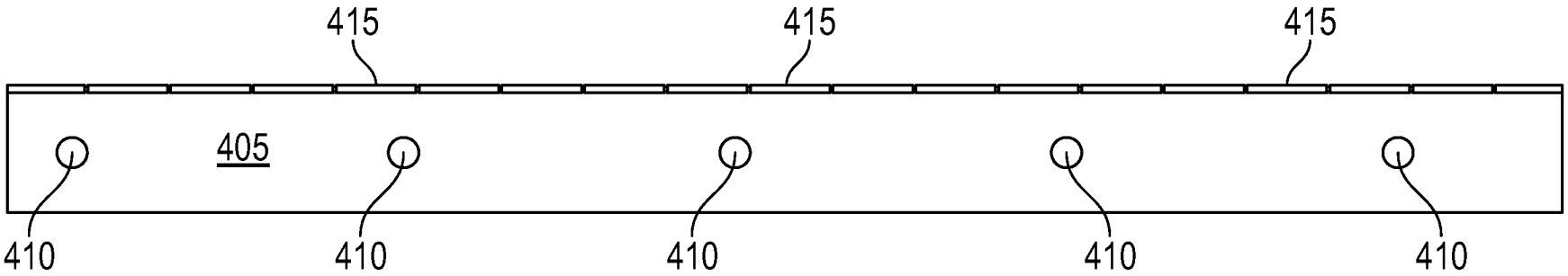
FIG. 14 is a front-side view of the exemplary embodiment of a pylon anchoring strip shown in FIG. 13.
Figure 15:
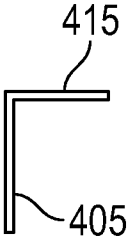
FIG. 15 is an end profile view of the exemplary embodiment of a pylon anchoring strip shown in FIG. 13.
Figure 16:
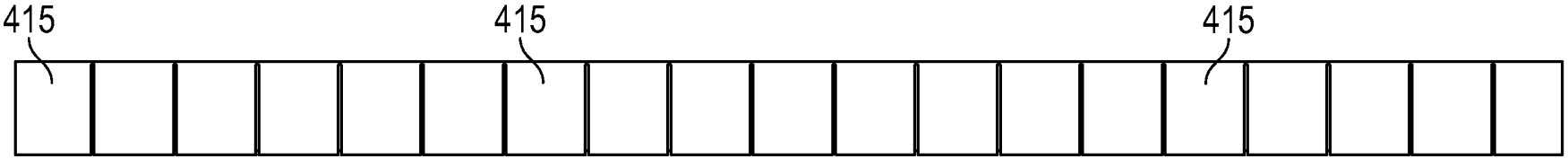
FIG. 16 is a top side view of the exemplary embodiment of a pylon anchoring strip shown in FIG. 13.

Turning now to the FIG. 13 illustration, shown is a perspective, front-side view of an exemplary embodiment 400 of a pylon anchoring strip according to the solution, the exemplary embodiment 400 featuring horizontal fin anchor elements 415 in an L-shaped profile. The FIG. 13 illustration will be described in combination with the illustrations in FIGS. 14, 15 and 16 which are front-side, end profile, and top side views, respectively, of the same embodiment illustrated in FIG. 13. One of ordinary skill in the art reading this description and viewing the illustrations shown in FIGS. 13-16 will easily understand the combination of features in the exemplary embodiment 400 that form the novel solution for a pylon anchoring strip and, moreover, will envision and understand alternative, equivalent combinations of features to those demonstrated in the illustrations of FIGS. 13-16 that would also fall within the scope of the novel solution.

The exemplary embodiment 400 for a pylon anchoring strip includes a single lower fastening surface 405. Notably, it is envisioned that the pylon anchoring strip 400 embodiment may be installed "upside down" such that the lower fastening strip 405 essentially becomes an upper fastening strip. Consequently, the illustration and description of the embodiment 400 in an orientation such that the fastening strip 405 is beneath the anchor fins 415 will not suggest that the embodiment 400, or similar embodiments, may not be installed in a different orientation.

The fastening surface 405 may comprise one or more fastener placement holes 410, labeled in the illustrations as fastener placement holes 410. As will become clearer from a review of figures that follow, the pylon anchoring strip 400 may be "wrapped" around a pylon such that the backside of fastening surface 405 contacts the outer surface of the pylon. Installation of fasteners such as, but not limited to, screws or nails, through fastener placement holes 410 operate to securely fix the pylon anchoring strip 400 to a pylon. It is envisioned, however, that all embodiments of a pylon anchoring strip according to the solution may not include fastener placement holes 410 because, depending on the relative thickness and material of construction for fastening surface 405, certain fasteners may be operable for installation through the fastening surface 405 without the benefit of a predefined placement hole 410.

With the pylon anchoring strip 400 wrapped around and attached to a pylon in the manner described, it can be appreciated that the plurality of fin anchor elements 415 will protrude horizontally outward and away from the pylon. Even so, it is envisioned, and will be appreciated by one of ordinary skill in the art, the fin anchor elements 415 may protrude outward and upward, or even outward and downward, from the pylon in alternative embodiments. In such alternative embodiments, the profile of the strip wouldn't be an "L" but, instead, would define either an acute or an obtuse angle. Each fin anchor element 415 is separate from its adjacent anchor elements, yet integrally connected to the fastening surface 405. In this way, each given fin anchor element 415 defines an L-shape profile with the fastening surface 405.

In the exemplary embodiment 400 for a pylon anchoring strip, the fin anchor elements 415 essentially extend radially outward horizontally from the pylon. As can probably best be understood from the end profile illustration in FIG. 15, when installed on a pylon, the fastening surface 405 is vertical and coplanar with the surface of the pylon while the fin anchor element(s) 415 protrude away from the pylon. As will become better understood from subsequent illustrations, the fin anchor element(s) 415 create resistance that mitigates any upheaval or shifting of the pylon from its set position. The lengths of the fin anchor elements 415 are design choices within the level of expertise of one with ordinary skill in the art and, as such, fall within the scope of the solution.

Figure 17:
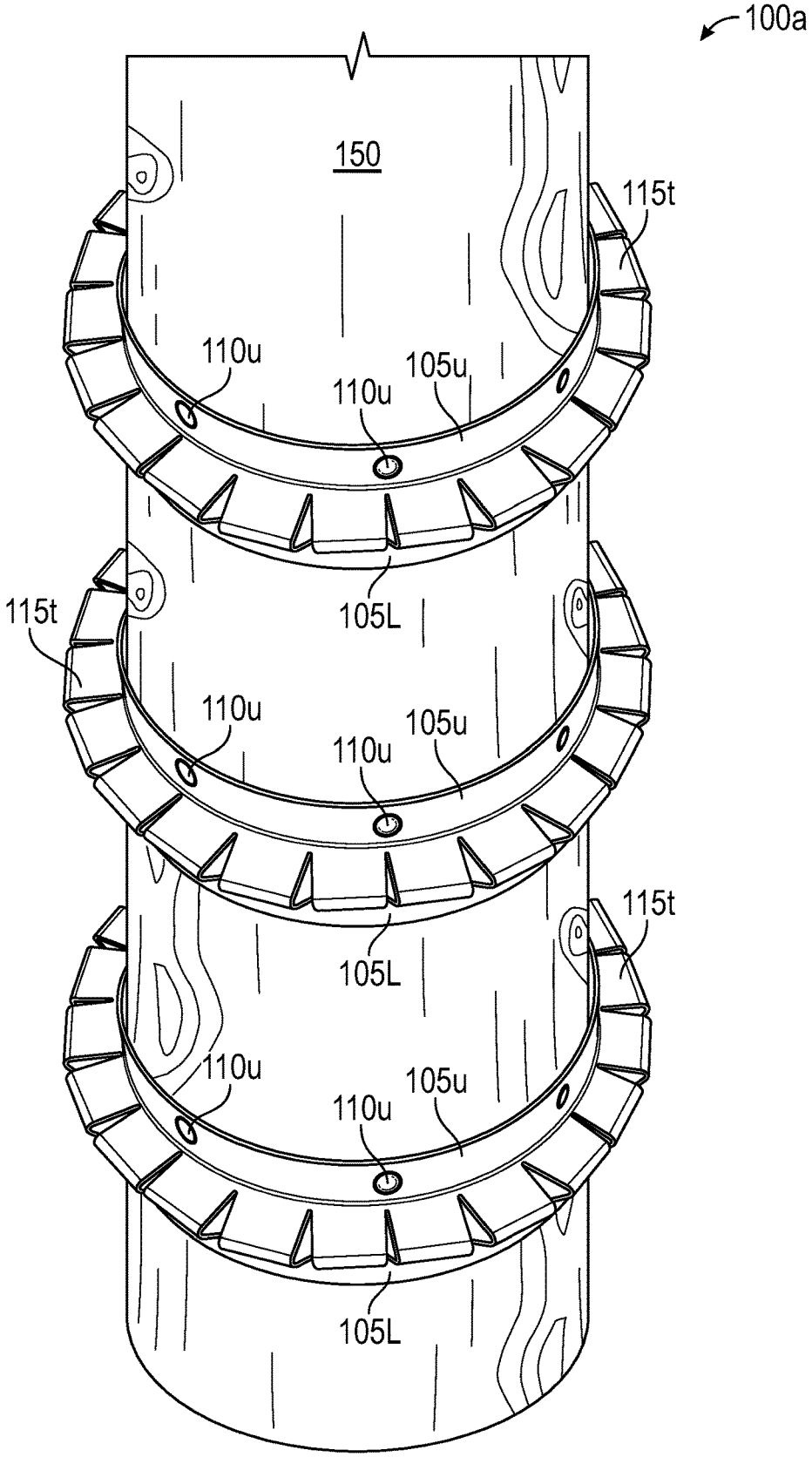
FIG. 17 illustrates the exemplary embodiment of a pylon anchoring strip shown in FIGS. 1-4 installed on a pylon in discretely spaced, individual wraps.

FIG. 17 illustrates the exemplary embodiment 100A of the pylon anchoring strip shown in FIGS. 1-4 installed on a pylon 150 in discretely spaced, individual wraps. As can be understood from the FIG. 17 illustration, lengths of the pylon anchoring strip 100 have been cut to approximate the circumference of the pylon 150. Each length is "wrapped" around the pylon 150 and secured in place via fasteners installed through upper and lower fastener placement holes 110U, 110L in upper and lower fastening surfaces 105U, 105L. The spacing between installed lengths of the pylon anchoring strip 100 is a choice for one of ordinary skill in the art, although it is envisioned that closer spacing and more lengths will increase resistance against shifting of the pylon from its set position.

Figure 18:
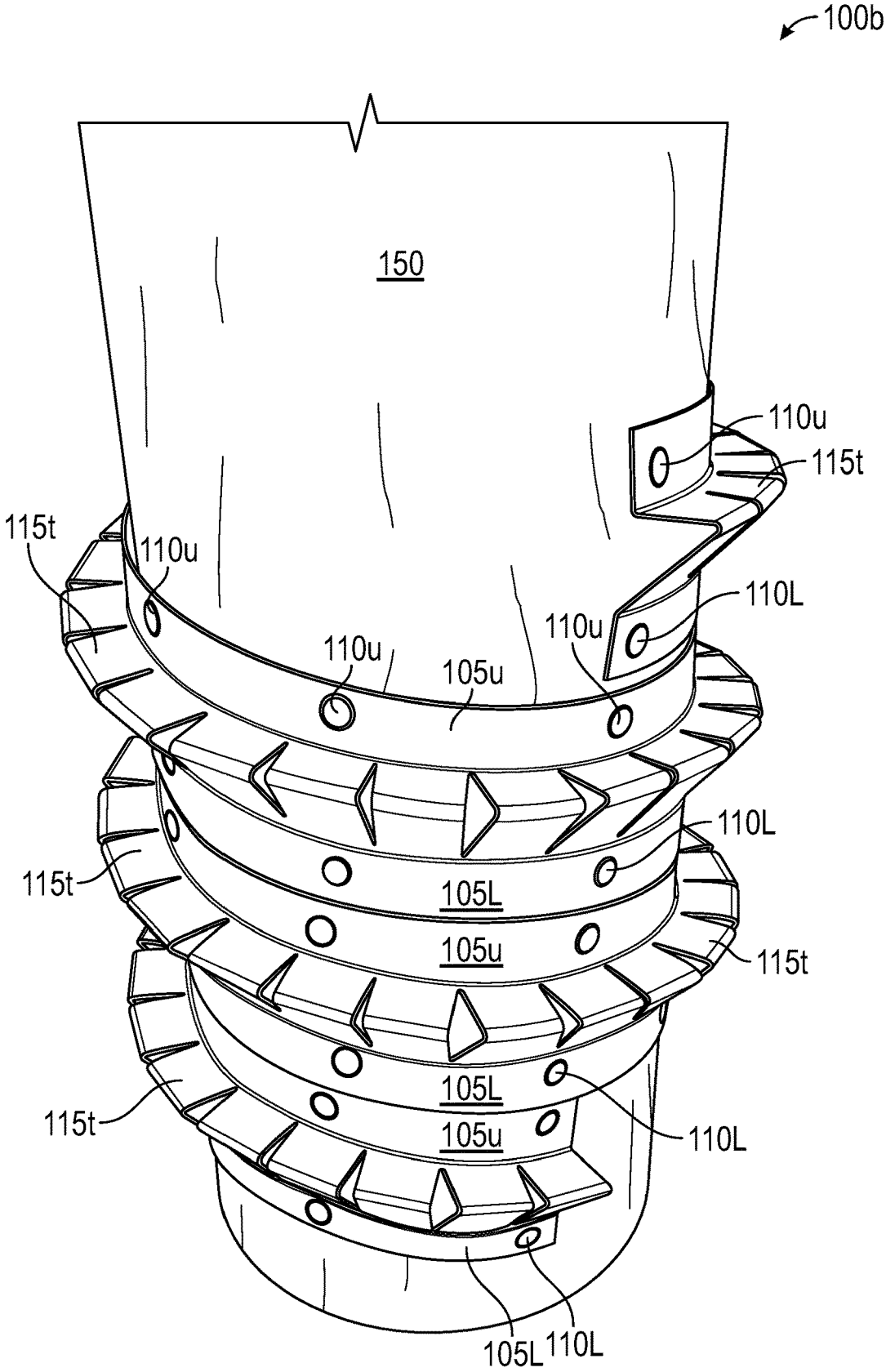
FIG. 18 illustrates the exemplary embodiment of a pylon anchoring strip shown in FIGS. 1-4 installed on a pylon in a spiral wrap.

FIG. 18 illustrates the exemplary embodiment 100B of th pylon anchoring strip shown in FIGS. 1-4 installed on a pylon 150 in a spiral wrap. As can be understood from the FIG. 18 illustration, a single, relatively long length of the pylon anchoring strip 100 has been cut such that it is operable to reach around the circumference of the pylon 150 multiple times. Notably, it is an advantage of embodiments of the solution that they may be extruded in relatively long lengths and then cut to preferred lengths in the field for installation. In the FIG. 18 illustration, the length is "wrapped" in a spiral manner around the pylon 150 and secured in place via fasteners installed through upper and lower fastener placement holes 110U, 110L in upper and lower fastening surfaces 105U, 105L. The amount of times that the pylon anchoring strip 100 is spiraled around the pylon 150 a choice for one of ordinary skill in the art, although it is envisioned that more wraps will increase resistance against shifting of the pylon from its set position.

Figure 19:
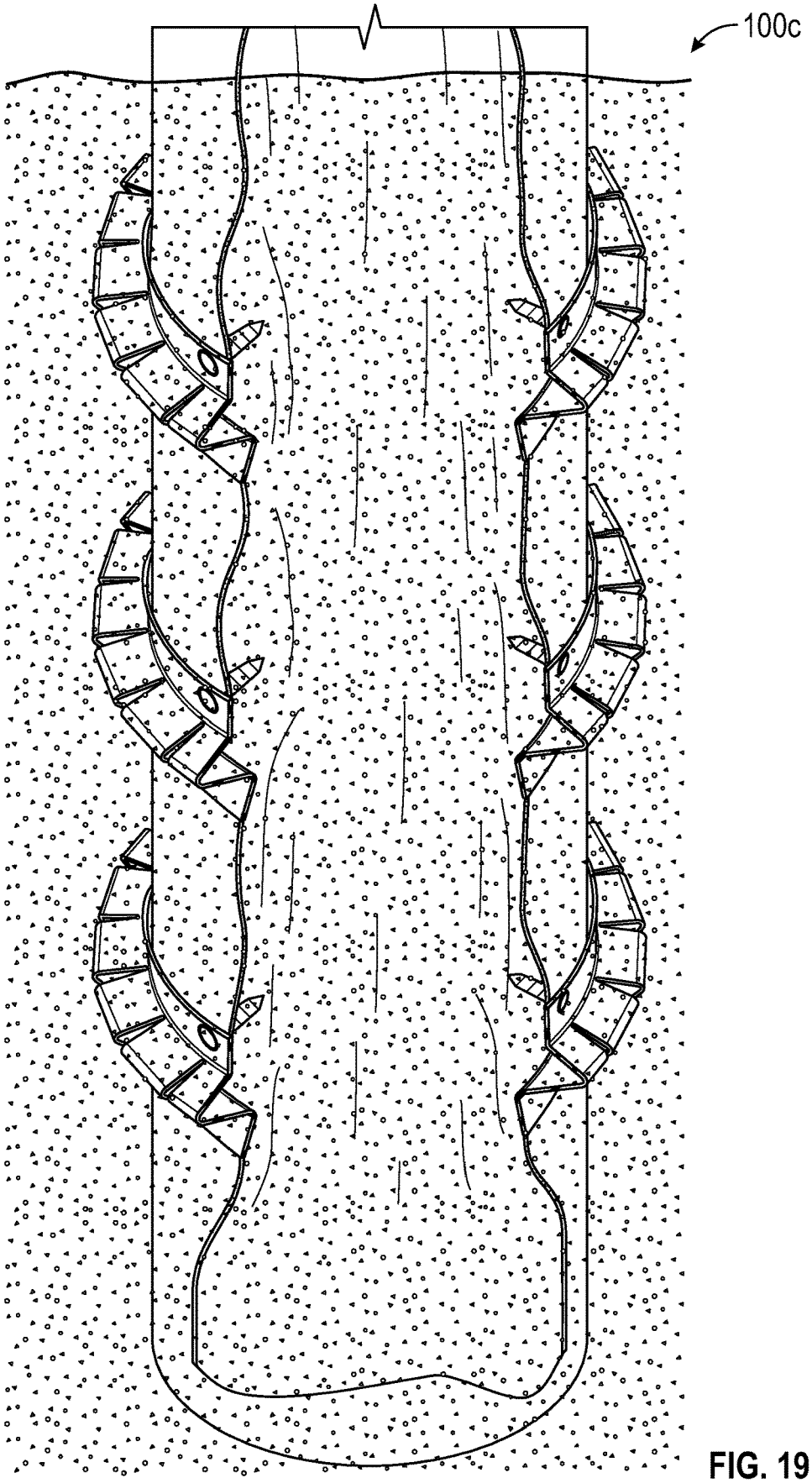
FIG. 19 is a cross-sectional view of the illustration of FIG. 17, shown with the pylon anchoring strip positioned beneath the sand line in order to mitigate shifting or upheaval of the pylon.

FIG. 19 is a cross-sectional view of the illustration of FIG. 17, shown with the pylon anchoring strip positioned beneath the sand line in order to mitigate shifting or upheaval of the pylon, as previously described. With the pylon installed in its set position, the pylon anchoring strip attached thereto is beneath the sand line such that any external force applied to the pylon that might cause the pylon to shift or upheave from its set position will be counteracted by a resistance force generated by the anchor elements of the pylon anchoring strip acting on the sand, as would be appreciated by one of ordinary skill in the study of engineering statics and dynamics.

Figure 20:
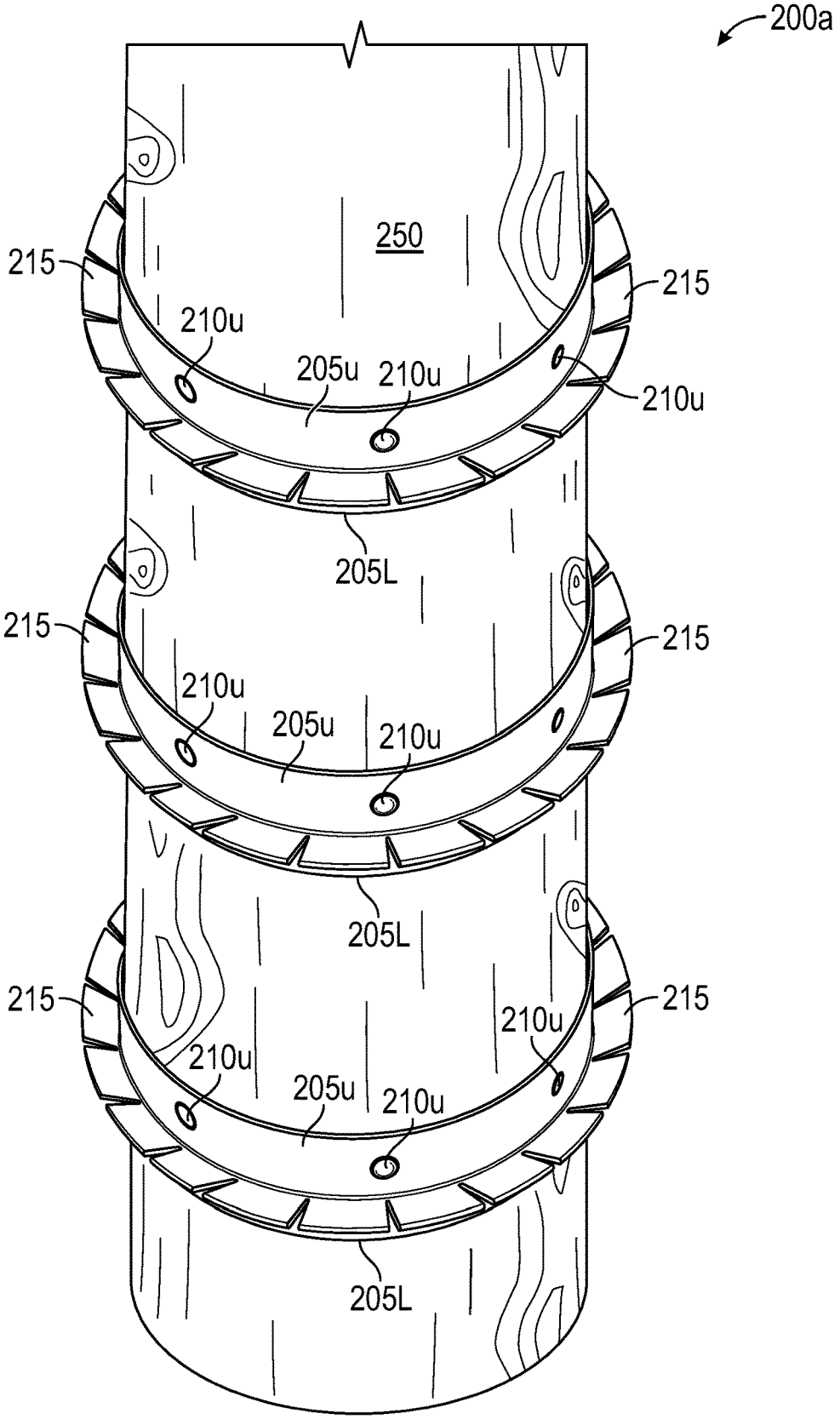
FIG. 20 illustrates the exemplary embodiment of a pylon anchoring strip shown in FIGS. 5-8 installed on a pylon in discretely spaced, individual wraps.

FIG. 20 illustrates the exemplary embodiment 200A of the pylon anchoring strip shown in FIGS. 5-8 installed on a pylon 250 in discretely spaced, individual wraps. As can be understood from the FIG. 20 illustration, lengths of the pylon anchoring strip 200 have been cut to approximate the circumference of the pylon 250. Each length is "wrapped" around the pylon 250 and secured in place via fasteners installed through upper and lower fastener placement holes 210U, 210L in upper and lower fastening surfaces 205U, 205L. The spacing between installed lengths of the pylon anchoring strip 200 is a choice for one of ordinary skill in the art, although it is envisioned that closer spacing and more lengths will increase resistance against shifting of the pylon from its set position. Notably, although not shown, one of ordinary skill in the art will appreciate that the pylon anchoring strip 200 may alternatively be cut to a relatively long length and installed in a spiral manner consistent with that which was previously described relative to the FIG. 18 illustration. Either way, installation of the pylon 250 with pylon anchoring strip 200 beneath the sand line will work to counteract any external force from causing the pylon 250 to shift or upheave from its set position.

Figure 21:
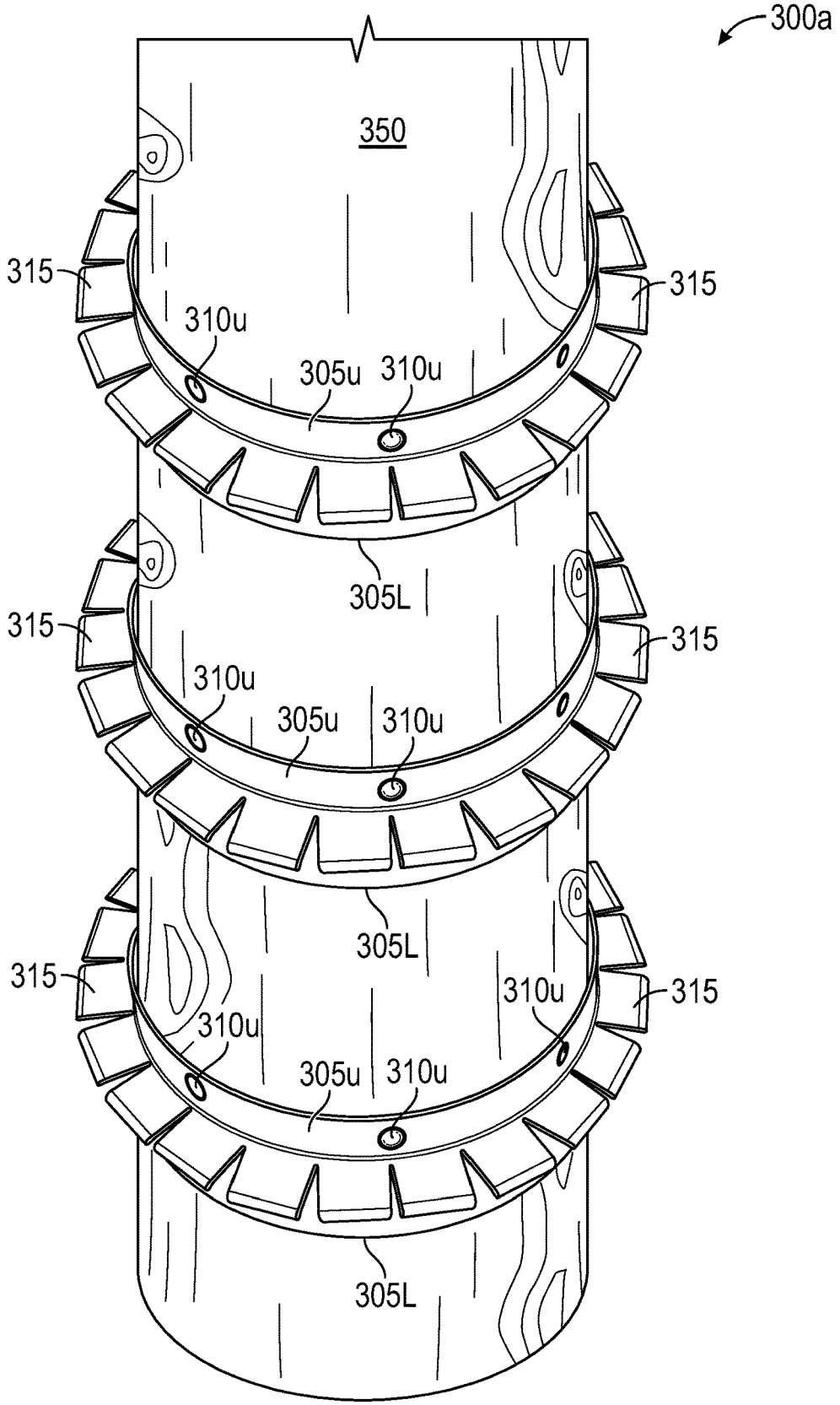
FIG. 21 illustrates the exemplary embodiment of a pylon anchoring strip shown in FIGS. 9-12 installed on a pylon in discretely spaced, individual wraps.

FIG. 21 illustrates the exemplary embodiment 300A of the pylon anchoring strip shown in FIGS. 9-12 installed on a pylon 350 in discretely spaced, individual wraps. As can be understood from the FIG. 21 illustration, lengths of the pylon anchoring strip 300 have been cut to approximate the circumference of the pylon 350. Each length is "wrapped" around the pylon 350 and secured in place via fasteners installed through upper and lower fastener placement holes

310U, 310L in upper and lower fastening surfaces 305U, 305L. The spacing between installed lengths of the pylon anchoring strip 300 is a choice for one of ordinary skill in the art, although it is envisioned that closer spacing and more lengths will increase resistance against shifting of the pylon from its set position. Notably, although not shown, one of ordinary skill in the art will appreciate that the pylon anchoring strip 300 may alternatively be cut to a relatively long length and installed in a spiral manner consistent with that which was previously described relative to the FIG. 18 illustration. Either way, installation of the pylon 350 with pylon anchoring strip 300 beneath the sand line will work to counteract any external force from causing the pylon 350 to shift or upheave from its set position.

Figure 22:
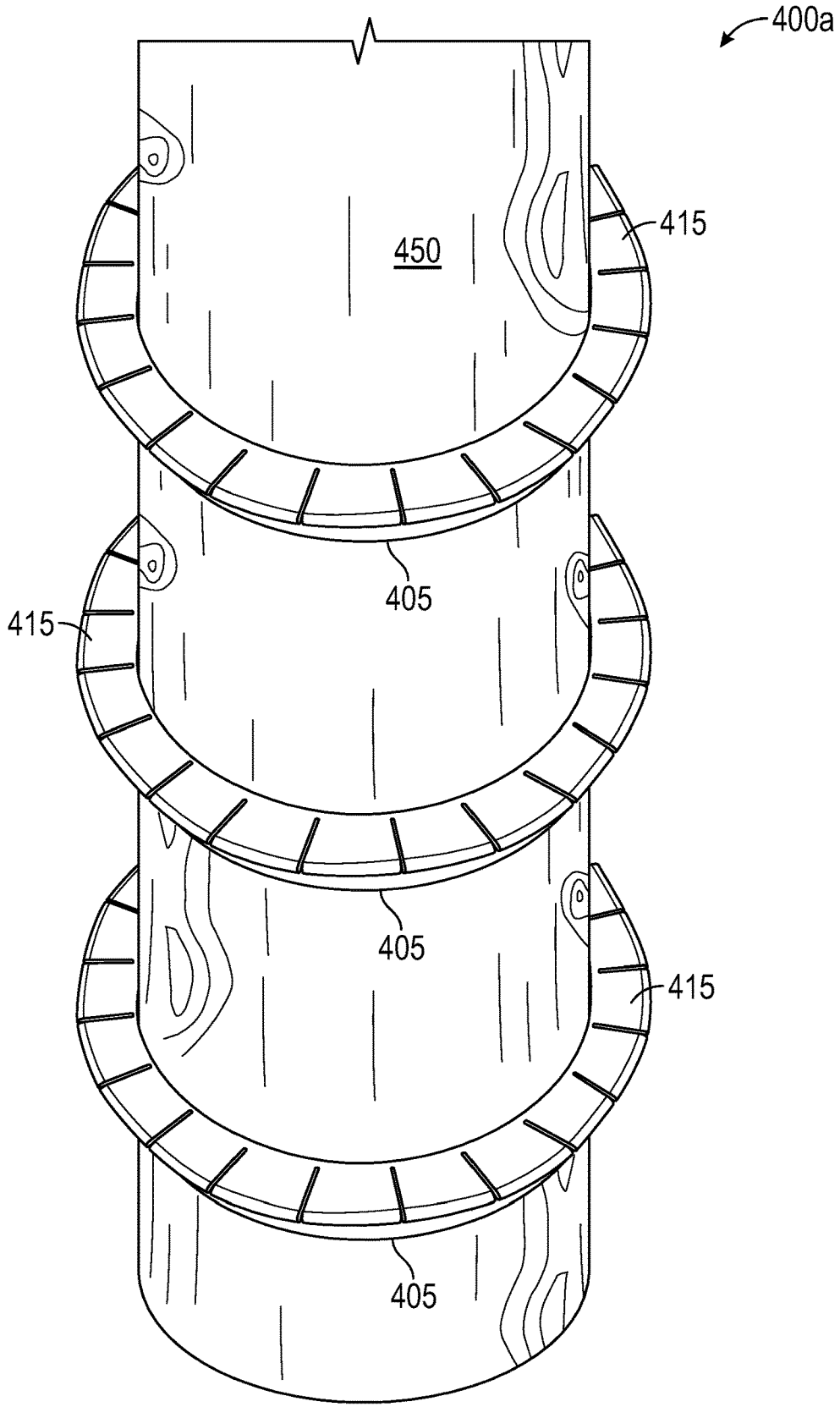
FIG. 22 illustrates the exemplary embodiment of a pylon anchoring strip shown in FIGS. 13-16 installed on a pylon in discretely spaced, individual wraps; and The Appendix includes exemplary, dimensional shop drawings of the various exemplary embodiments of the pylon anchoring strip demonstrated in the figures.

FIG. 22 illustrates the exemplary embodiment 400A of the pylon anchoring strip shown in FIGS. 13-16 installed on a pylon 450 in discretely spaced, individual wraps. As can be understood from the FIG. 22 illustration, lengths of the pylon anchoring strip 400 have been cut to approximate the circumference of the pylon 450. Each length is "wrapped" around the pylon 450 and secured in place via fasteners installed through fastener placement holes 410 in fastening surface 405. The spacing between installed lengths of the pylon anchoring strip 400 is a choice for one of ordinary skill in the art, although it is envisioned that closer spacing and more lengths will increase resistance against shifting of the pylon from its set position. Notably, although not shown, one of ordinary skill in the art will appreciate that the pylon anchoring strip 400 may alternatively be cut to a relatively long length and installed in a spiral manner consistent with that which was previously described relative to the FIG. 18 illustration. Either way, installation of the pylon 450 with pylon anchoring strip 400 beneath the sand line will work to counteract any external force from causing the pylon 450 to shift or upheave from its set position.

Systems, devices and methods for pylon anchoring have been described using detailed descriptions of embodiments thereof that are provided by way of example and are not intended to limit the scope of the disclosure. The described embodiments comprise different features, not all of which are required in all embodiments of a pylon anchoring strip. Some embodiments of a pylon anchoring strip utilize only some of the features or possible combinations of the features. Variations of embodiments of a pylon anchoring strip that are described and embodiments of a pylon anchoring strip comprising different combinations of features noted in the described embodiments will occur to persons of the art.

Further, certain steps for installing embodiments of a pylon anchoring strip naturally precede others for the solution to function as described. However, installation and use of a pylon anchoring strip is not limited to any order if such order or sequence does not alter the functionality of the solution. In some instances, certain steps for installing and using a pylon anchoring system according to the solution may be omitted or not performed without departing from the scope of the disclosure.

Therefore, although selected aspects have been illustrated and described in detail, it will be understood that various substitutions and alterations may be made therein without departing from the spirit and scope of the present invention, as defined by the following claims.

What is claimed is:

1. A pylon anchoring strip, comprising:

an upper fastening surface and a lower fastening surface, wherein when the pylon anchoring strip is in an installed condition on a post or pylon the upper and lower fastening surfaces are wrapped around an exterior of the post or pylon;

a plurality of fasteners installed through the upper and lower fastening surfaces such that the pylon anchoring strip is affixed to the exterior of the post or pylon; and a plurality of anchor elements extending away from the post or pylon when the upper fastening surface and lower fastening surface are wrapped around the exterior of the post or pylon;

wherein the pylon anchoring strip is substantially linear prior to installation on the post or pylon; and wherein when the post or pylon is installed such that the pylon anchoring strip is positioned beneath sand, the plurality of anchor elements generate a counteracting force to any external force that might cause the pylon to shift from a set position.

2. The pylon anchoring strip of claim 1, wherein at least one of the upper and lower fastening surfaces comprises one or more fastener placement holes.

3. The pylon anchoring strip of claim 1, wherein the plurality of anchor elements define a triangular profile.

4. The pylon anchoring strip of claim 1, wherein the plurality of anchor elements define fins.

5. The pylon anchoring strip of claim 1, wherein the fastening surface is wrapped around the exterior of a post or pylon in a spiral manner.

6. The pylon anchoring strip of claim 1, wherein when the pylon anchoring strip is in a substantially linear condition prior to installation, the plurality of anchor elements extending away from the post or pylon define a common axis.

7. A pylon anchoring strip, comprising:

a fastening surface, wherein when the pylon anchoring strip is in an installed condition on a post or pylon the fastening surface is wrapped around an exterior of the post or pylon;

a plurality of fasteners installed through the fastening surface such that the pylon anchoring strip is affixed to the exterior of the post or pylon; and a plurality of anchor elements extending away from the post or pylon when the fastening surface is wrapped around the exterior of the post or pylon;

wherein the pylon anchoring strip is substantially linear prior to installation on the post or pylon; and wherein when the post or pylon is installed such that the pylon anchoring strip is positioned beneath sand, the plurality of anchor elements generate a counteracting force to any external force that might cause the pylon to shift from a set position.

8. The pylon anchoring strip of claim 7, wherein the fastening surface comprises one or more fastener placement holes.

9. The pylon anchoring strip of claim 7, wherein the plurality of anchor elements define fins.

10. The pylon anchoring strip of claim 7, wherein the fastening surface is wrapped around the exterior of a post or pylon in a spiral manner.

11. The pylon anchoring strip of claim 7, wherein when the pylon anchoring strip is in a substantially linear condition prior to installation, the plurality of anchor elements extending away from the post or pylon define a common axis.

* * * * *